US009322307B2

(12) United States Patent
Andersson Aginger

(10) Patent No.: US 9,322,307 B2
(45) Date of Patent: Apr. 26, 2016

(54) DEVICE COMPRISING A CENTRIFUGAL SEPARATOR AND A DRIVE ARRANGEMENT INCLUDING AN IMPULSE TURBINE

(75) Inventor: Thomas Andersson Aginger, Skärholmen (SE)

(73) Assignee: ALFA LAVAL CORPORATE AB, Lund (SE)

( * ) Notice: Subject to any disclaimer, the term of this patent is extended or adjusted under 35 U.S.C. 154(b) by 177 days.

(21) Appl. No.: 14/007,791

(22) PCT Filed: May 11, 2012

(86) PCT No.: PCT/EP2012/058786
§ 371 (c)(1),
(2), (4) Date: Sep. 26, 2013

(87) PCT Pub. No.: WO2012/152925
PCT Pub. Date: Nov. 15, 2012

(65) Prior Publication Data

US 2014/0018227 A1 Jan. 16, 2014

(30) Foreign Application Priority Data

May 12, 2011 (EP) ..... 11165854

(51) Int. Cl.

| | |
|---|---|
| ***F01M 13/04*** | (2006.01) |
| ***B04B 9/06*** | (2006.01) |
| ***B04B 5/00*** | (2006.01) |
| ***B04B 5/12*** | (2006.01) |

(52) U.S. Cl.
CPC ..... *F01M 13/04* (2013.01); *B04B 5/005* (2013.01); *B04B 5/12* (2013.01); *B04B 9/06* (2013.01); *F01M 2013/0422* (2013.01)

(58) Field of Classification Search
CPC ..... B04B 5/005; B04B 5/12; B04B 9/06; F01M 13/04; F01M 2013/0422
USPC ..... 494/43, 23, 24, 27
See application file for complete search history.

(56) References Cited

U.S. PATENT DOCUMENTS 1,681,705 A * 8/1928 Moody ..... F03B 1/02 415/155
4,295,788 A * 10/1981 Dussourd ..... F01D 1/34 415/202
5,536,289 A 7/1996 Spies et al.
(Continued)

FOREIGN PATENT DOCUMENTS

CN 1300240 A 6/2001
CN 101189414 A 5/2008
(Continued)

*Primary Examiner* — Charles Cooley
*Assistant Examiner* — Shuyi S Liu
(74) *Attorney, Agent, or Firm* — Birch, Stewart, Kolasch & Birch, LLP

(57) ABSTRACT

A device for cleaning a gas which is contaminated with particles, includes a centrifugal separator with a centrifugal rotor for separating the particles from the gas and a drive arrangement for rotating the centrifugal rotor about a rotational axis. The drive arrangement includes an impulse turbine drivingly connected to the centrifugal rotor and a nozzle for a pressurized fluid, the impulse turbine being arranged with buckets for receiving a jet of pressurized fluid from a nozzle directed against the buckets which are configured such that the fluid jet direction is reversed along a height of the bucket. The height of the bucket is 2-3 times the diameter of the nozzle opening.

20 Claims, 2 Drawing Sheets

(56) References Cited

U.S. PATENT DOCUMENTS

| | | | | |
|---|---|---|---|---|
| 6,019,717 | A | 2/2000 | Herman | |
| 6,210,311 | B1 * | 4/2001 | May | 494/24 |
| 6,332,754 | B1 * | 12/2001 | Matsuda | F01D 1/04 415/191 |
| 7,152,589 | B2 | 12/2006 | Ekeroth et al. | |
| 8,172,917 | B2 | 5/2012 | Kup et al. | |
| 2004/0025482 | A1 | 2/2004 | Borgstrom et al. | |
| 2009/0223496 | A1 | 9/2009 | Borgstrom et al. | |
| 2011/0070064 | A1 * | 3/2011 | Glynn | F01D 5/14 415/1 |
| 2015/0068172 | A1 * | 3/2015 | Andersson Aginger et al. | 55/385.3 |

FOREIGN PATENT DOCUMENTS

| | | | | |
|---|---|---|---|---|
| DE | 10044922 | A1 | 4/2002 | |
| DE | 102004061938 | B3 | 6/2006 | |
| EP | 1 008 391 | A2 | 6/2000 | |
| EP | 1008391 | A2 * | 6/2000 | B04B 9/06 |
| EP | 1085945 | B1 | 6/2006 | |
| EP | 1532353 | B1 | 11/2009 | |
| SE | 527877 | C2 | 7/2006 | |
| SU | 1650206 | A1 | 5/1991 | |
| WO | WO 99/56883 | A1 | 11/1999 | |
| WO | WO 2007/071373 | A2 | 6/2007 | |
| WO | WO 2011/005160 | A1 | 1/2011 | |

* cited by examiner

DEVICE COMPRISING A CENTRIFUGAL SEPARATOR AND A DRIVE ARRANGEMENT INCLUDING AN IMPULSE TURBINE

TECHNICAL FIELD

The invention relates to a device for cleaning a gas which is contaminated with particles. The device comprises a centrifugal separator with a centrifugal rotor for separating the particles from the gas. The device further comprises a drive arrangement for rotating the centrifugal rotor about a rotational axis. The drive arrangement comprises an impulse turbine drivingly connected to the centrifugal rotor and a nozzle for a pressurized fluid. The impulse turbine is arranged with buckets for receiving a jet of pressurized fluid from the nozzle directed against the buckets which are configured such that the fluid jet direction is reversed along a height of the bucket.

TECHNICAL BACKGROUND

WO 99/56883 A1 discloses a previously known device having a centrifugal separator with a centrifugal rotor for separating particles from a gas. The centrifugal separator is arranged to be driven by a pressure fluid which is generated by a combustion engine, wherein the centrifugal rotor is arranged with a pneumatic or hydraulic motor, for instance a turbine, which is adapted to be rotated by the pressure fluid. The drive arrangement of this known device enables, in a simple manner, both a very high rotational speed of the centrifugal rotor and that the centrifugal separator may be located at a desired place near the combustion engine. This makes the device useful for cleaning crankcase gas from a combustion engine.

WO 2011/005160 A1 discloses a further device including a centrifugal separator for cleaning crankcase gas with a centrifugal rotor which is driven by a pressure fluid via an impulse turbine. In particular the impulse turbine (shown in more detail in FIGS. 1 and 29-34) is arranged with buckets for receiving a jet of pressurized fluid from a nozzle directed against the buckets. The buckets are configured such that the fluid jet direction is reversed along a height of the bucket. This turbine has proven to be both simple and effective in driving the centrifugal rotor.

These drive arrangements are often adapted for the specific operating conditions of the centrifugal separator. One aspect is to make the drive arrangement as efficient as possible. There is a desire to keep the energy consumption of the drive arrangement at a minimum, while maintaining or even increasing the separating efficiency of the centrifugal separator.

SUMMARY OF THE INVENTION

An object of the invention is to increase the efficiency of the drive arrangement for a centrifugal separator.

This object is achieved by the initially defined device which is characterized in that the bucket height is 2-3 times the diameter of the nozzle opening.

The previously known impulse turbine had a bucket height of approximately five times the diameter of the nozzle opening. By shortening this height, in accordance with the invention, the efficiency of the impulse turbine is surprisingly increased. Hence, the power for driving the centrifugal rotor is utilized more efficiently at high rotational speeds. The impulse turbine is optimized for high speed rotation and thereby better separating performance for the centrifugal separator is achieved. The shorter distance the fluid jet has to travel inside the bucket the better. However, the bucket height should not be less than two times the diameter of the fluid jet, since that would result in a collision between the incoming and reversed part of the fluid jet. Such a collision would reduce the efficiency of the turbine significantly.

A bucket height of more than three times the nozzle diameter will also reduce the efficiency of the impulse turbine at high rotational speeds. The reason is that a high speed rotation of the centrifugal rotor does not give the fluid jet enough time to travel the longer distance inside the bucket and be reversed effectively. Accordingly, the impulse turbine would rotate and turn away too much from the nozzle before the fluid jet has been sufficiently reversed. The impulse from the fluid jet is therefore ineffectively transferred to the turbine. The impulse turbine and centrifugal rotor may rotate at a speed ranging from 6 000 to 14 000 rpm. By decreasing the height of the turbine in accordance with the invention the fluid jet is reversed in time and the efficiency of the turbine is significantly improved at the higher speed ranges. The new turbine may hereby provide a higher power output for driving the centrifugal rotor already at a speed of 5000 rpm with a given pressure on the fluid and nozzle size compared to the previously known turbine.

Furthermore, the invention provides a turbine or drive arrangement of reduced size. This is a very important aspect in for instance crankcase gas cleaning. In crankcase gas cleaning, the centrifugal separator must be adapted to be mounted in a very limited space, either inside or somewhere around the combustion engine of a vehicle. The centrifugal separator with the drive arrangement may either be mounted inside the engine room or inside a confined space within the combustion engine (e.g. within a cylinder head cover or valve cover).

Within the above mentioned interval of 2 to 3 times the diameter of the nozzle, the height of the bucket may with advantage be in the lower region of the interval, i.e. 2-2.5 times the diameter of the nozzle opening. Furthermore, within this narrower interval, said height may with advantage be 2.3 times the diameter of the nozzle opening.

The impulse turbine or centrifugal rotor may either have a horizontal or vertical rotational axis. Hence, the term "height" of the bucket does not imply a vertical orientation of these components. Instead, the impulse turbine and centrifugal rotor may as well be arranged to rotate around a horizontal rotational axis. If the impulse turbine is considered to have a cylindrical shape, the "height" is the extension in the lengthwise direction of that cylinder.

The fluid jet may be in the form of a gas, but more preferably it is a liquid which generates a greater driving force.

The radius of the impulse turbine may with advantage be configured such that a ratio between the fluid jet speed and the tangential speed of the impulse turbine, at the radius where the fluid jet is arranged to hit the bucket, is 2-3 during operation of the centrifugal separator. Hence, the fluid jet speed is at least 2 times but not more than 3 times the tangential speed of the impulse turbine in operation (or in other words; the tangential speed of the turbine is ⅓ to ½ of the fluid jet speed). Some operating conditions of the device are many times given. For instance, the fluid jet speed may be given by a specific nozzle and a predetermined operating pressure on the fluid. With given input conditions the turbine will run at different speeds depending of the load applied. However, the centrifugal rotor is intended to operate within a specific load range, which depends on the intended rotational speed and the amount of gas which flows through the centrifugal rotor per unit time. Accordingly, the turbine radius is configured in view of these operating conditions, such that the fluid jet speed is 2 to 3 times the tangential speed of the turbine. Within this range the power curve of the present impulse turbine peaks.

In this way the turbine efficiency has been further increased in view of for instance the previous impulse turbine according to WO 2011/005160 A1. The previous turbine had a significantly greater radius. In fact the new turbine radius is almost half of the previous turbine radius, and furthermore yields higher rotational speeds at given fluid pressure. Accordingly, the size of the turbine and drive arrangement is further reduced, and the rotational speed of the centrifugal rotor is increased. Within the mentioned range the radius of the impulse turbine may with advantage be configured such that the ratio is 2.2-2.6. It may also with advantage be configured such that said ratio is 2.4. Accordingly, at optimum operation condition of the centrifugal separator, the fluid jet speed would be 2.4 times the tangential turbine speed at the point where the fluid jet hits the bucket.

The opening of the nozzle may be arranged at a distance of 0.5-5 mm from the impulse turbine. As the fluid jet exits the nozzle, the diameter of the jet expands in a conical manner to become less focused or concentrated with the distance from the nozzle opening. The nozzle opening should be as close as possible to the bucket. In this way, the impulse from the fluid jet acts on the bucket more effectively as the fluid jet is relatively focused in the vicinity of the nozzle opening. Furthermore, the closer they are together the more the diameter of the fluid jet resembles the diameter of the nozzle opening. Thus, the diameter of the fluid jet is substantially the same as the diameter of the nozzle opening when said distance is short. However, manufacturing tolerances limits this distance to 0.5 mm, since a shorter distance would risk damage to the drive arrangement due to the nozzle and the impulse turbine coming into contact with each other during operation.

The buckets of the impulse turbine may preferably be configured with an inner curved part for reversing the fluid along the height of the bucket, which inner curved part transitions into outer straight parts diverging in a radial outward direction. The straight outwardly diverging parts of the bucket are configured to funnel the fluid jet into and out of the curved part of the bucket. Hence, if the fluid jet enters an upper half of the bucket, the upper straight part guides the fluid jet into the curved part and the lower straight part guides the fluid jet out of the bucket.

As previously mentioned, the centrifugal separator may with advantage be adapted for cleaning crankcase gas produced by a internal combustion engine during operation, wherein the nozzle is connectable to a fluid pressure source of the combustion engine. The device is particularly suitable for cleaning crankcase gas, because of the relatively small sized drive arrangement. Furthermore, the impulse turbine has been found to be very effective within the operating ranges associated with crankcase gas cleaning, e.g. in terms of the desired high rotational speeds and the actual loads on the centrifugal rotor. As previously mentioned the rotational speed of the centrifugal rotor will typically range from 6 000 to 14 000 rpm. The load on the centrifugal rotor increases with rotational speed and the amount of gas which flows through the centrifugal rotor per unit time. The crankcase gas rates or so called blow-by gas rates, through the centrifugal separator, may range from 40 to 800 liters per minute depending on the combustion engine and its operating conditions. Furthermore, the fluid is preferably a liquid, wherein the fluid pressure source is a liquid pump of the combustion engine. This is because liquid provides more kinetic energy than gas due to its higher density.

The fluid pressure source of the combustion engine may for instance be an oil or water pump which is drivingly connected to the combustion engine. Accordingly, the fluid for driving the impulse turbine may be oil or water, which is pressurized by said oil or water pump respectively. In many cases, the pump speed will depend on the engine speed, whereby a decrease in engine speed gives lower pressure on the liquid from the pump. However, the present impulse turbine is very efficient within the above mentioned operating ranges and in particular when the pressure source generates a relatively low pressure (e.g. a maximum pressure of 2-5 bars).

The drive arrangement may be provided with a housing for the impulse turbine and the nozzle, the housing enclosing a drive chamber for the centrifugal rotor. This housing could furthermore be provided with a wall element including a conduit for the nozzle, the conduit having a connection to the fluid pressure source in an interface surface which is connectable to the combustion engine. This provides a simple and effective way of connecting the drive arrangement to the combustion engine. The invention involves an improvement in that a very compact housing may be provided, since the turbine exhibits a reduced size.

BRIEF DESCRIPTION OF THE DRAWINGS

The invention will be further explained by a description of an embodiment in the following with reference to the accompanying drawings, in which.

DETAILED DESCRIPTION OF AN EMBODIMENT OF THE INVENTION

Figure 1:
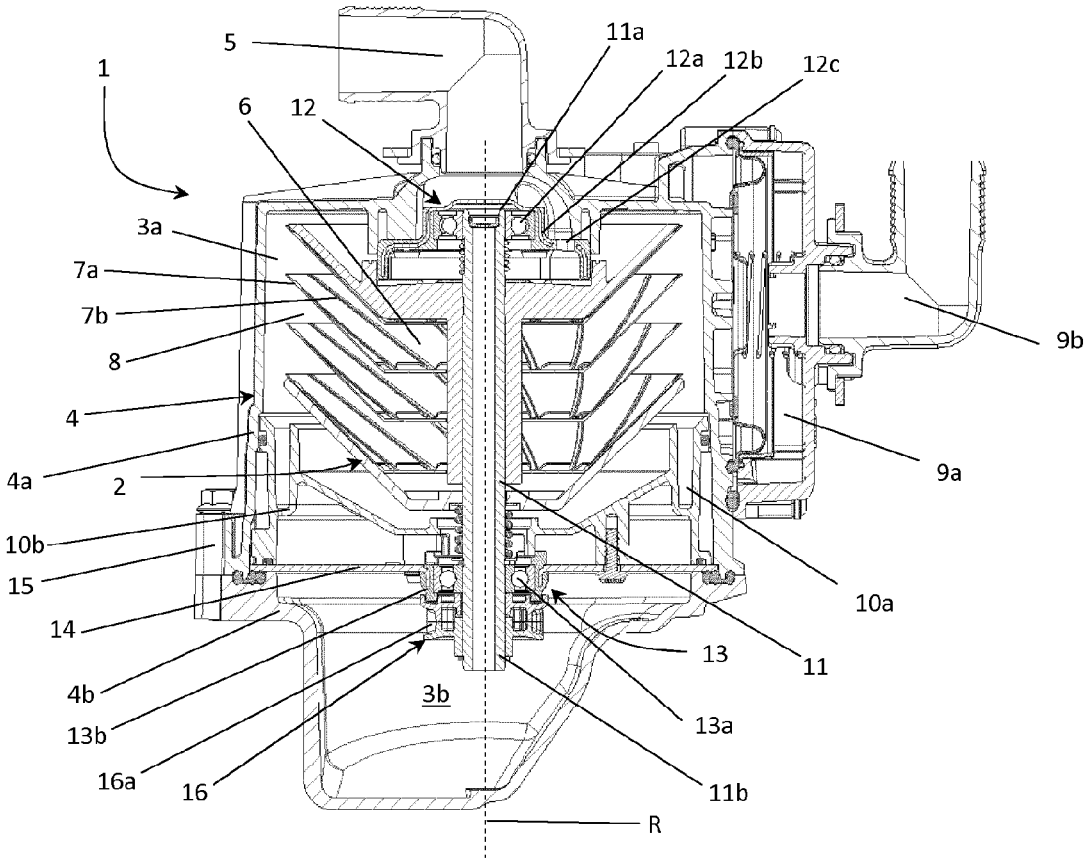
FIG. 1 shows a longitudinal section of a centrifugal separator having a centrifugal rotor with an impulse turbine.

FIG. 1 shows a device for cleaning crankcase gas from a combustion engine. The device includes a centrifugal separator 1 with a centrifugal rotor 2 which is rotatable around a rotational axis R. The centrifugal rotor 2 is situated in a separation chamber 3*a* inside a stationary housing 4. The stationary housing 4 has a gas inlet 5 which is configured to conduct the contaminated crankcase gas into a central space 6 inside the centrifugal rotor 2. The centrifugal rotor 2 includes of stack of separation discs 7*a* arranged on top of each other. The separation discs 7*a* have elongated distance members 7*b* to provide axial interspaces 8 for through-flow of the gas from the central space 6 and radially outwardly. The height of the distance members 7*b* determines the size of the axial interspaces 8. Only a few separation discs 7*a* are shown with heavily exaggerated sizes on the interspaces 8. In practice, the centrifugal rotor 2 would include a much greater number of separation discs 7*a* with a lot smaller interspaces 8.

During operation the centrifugal rotor 2 brings the gas into rotation, whereby the contaminants are separated be centrifugal force as the gas flows through the interspaces 8 of the centrifugal rotor 2. The interspaces 8 open into a radial outer part of the separation chamber 3*a* which surrounds the centrifugal rotor 2. The cleaned gas is discharged into this outer part of the separation chamber 3*a* and is conducted out of the centrifugal separator 1 via a pressure regulating valve 9*a* and a gas outlet 9*b*. The pressure regulating valve 9*a* is provided to keep the gas pressure inside the crankcase within a safe range. The centrifugal forces acting on the rotating gas will cause the particulate contaminants to deposit on the surfaces of the separation discs 7*a*. Separated contaminants will thereafter be thrown from the separation discs 7*a* of the centrifugal rotor 2 onto the inside wall of the stationary housing 4. The contaminants may then flow down along the inner wall to an annular collection groove 10*a* which communicate with a drain outlet 10*b* for conducting the collected contaminants out of the centrifugal separator 1.

The stack of separation discs 7*a* is arranged on a shaft 11 which rotatably supports the centrifugal rotor 2 in the stationary housing 4. The shaft 11 has a first end 11*a* which is supported in a first bearing unit 12. The first bearing unit 12 has a bearing 12*a* and a bearing holder 12*b* connected to the housing 4 at the gas inlet 5. The first bearing holder 12*b* is cap-shaped and arranged across the gas inlet 5, wherein the bearing holder 12*b* is provided with apertures 12*c* for allowing crankcase gas to pass from the gas inlet 5 into the central space 6 inside the centrifugal rotor 2. Furthermore, a second bearing unit 13 is arranged near a second end 11*b* of the shaft. Hence, the first and second bearing units 12, 13 are arranged on opposite sides of the stack of separation discs 7*a*. The second bearing unit 13 includes a bearing 13*a* in a bearing holder 13*b* which is connected to the housing 4 via a partition 14.

The partition 14 divides the interior of the housing 4 into the separation chamber 3*a* and a drive chamber 3*b*. The drive chamber 3*b* for the centrifugal rotor 2 is shown below the partition 14. The housing 4 has a first housing part 4*a* for the separation chamber 3*a* and a second housing part 4*b* for the drive chamber 3*b*. The first and second housing parts 4*a*, 4*b* are connected to each other by means of screws 15, wherein the partition 14 is arranged to be clamped in between the housing parts 4*a*, 4*b*. The shaft 11 extends through the partition 14 and into the drive chamber 3*b*. The drive chamber 3*b* encloses a drive arrangement for the centrifugal rotor 2. The drive arrangement comprises an impulse turbine 16 drivingly connected to the second end 11*b* of the shaft. Accordingly, the impulse turbine 16 is arranged to rotate the centrifugal rotor 2. The impulse turbine 16 is arranged with buckets 16*a* for receiving a jet of pressurized oil from a nozzle (not shown in FIG. 1) directed against the buckets 16*a*. The buckets 16*a* are configured such that the oil jet direction is reversed along a height H of the bucket 16*a*. In this case, the bucket height H is measured in the vertical direction.

Figure 2:
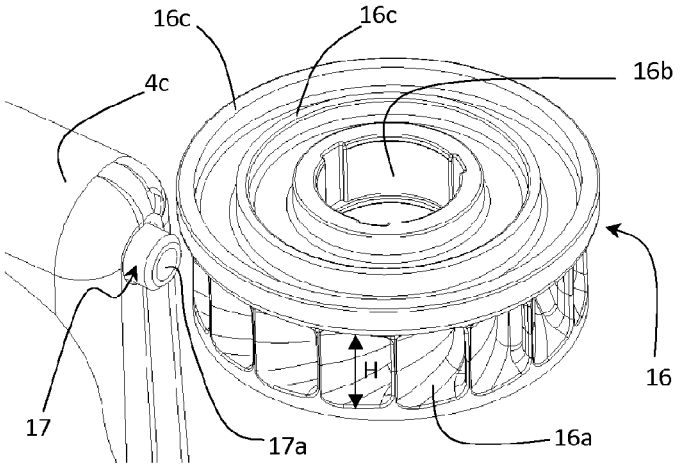
FIG. 2 shows a view of an impulse turbine and a nozzle in isolation.
Figure 3:
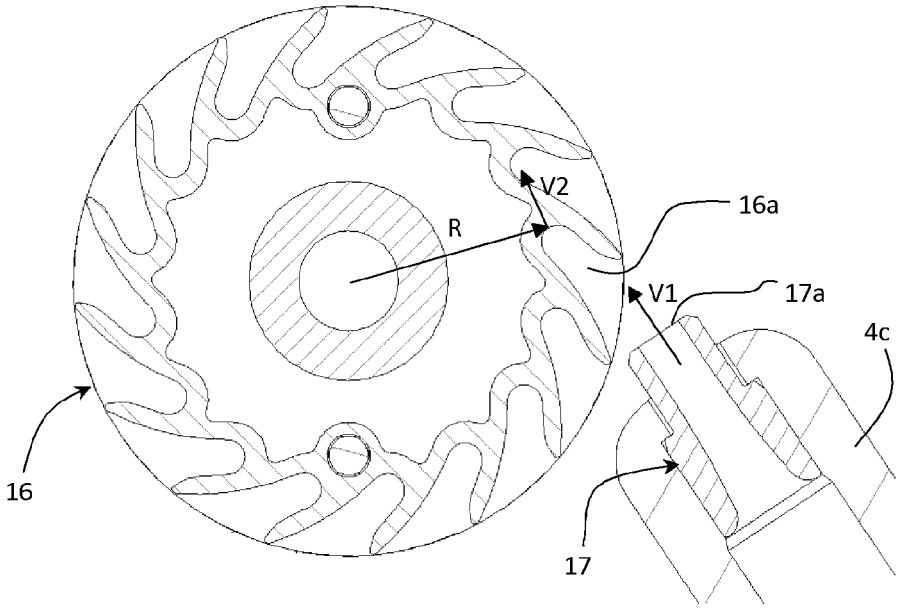
FIG. 3 shows a cross-section of the impulse turbine and nozzle in isolation.

FIG. 2 shows the impulse turbine 16 and the nozzle 17 in isolation. The shown nozzle 17 is arranged in a wall member 4*c* of the drive chamber housing 4*b*. The nozzle 17 is connected via a conduit (not shown) inside the wall member 4*c* to a lubricating oil pump of the combustion engine. Hence, while the engine is running the lubricating oil pump delivers pressurized oil for the nozzle 17 to rotate the impulse turbine 16 and the centrifugal rotor 2. As shown the impulse turbine 16 is arranged with a central through-hole 16*b* for connection to the shaft 11. Furthermore, the upper surface of the impulse turbine 16 facing the second bearing unit 13 is configured with a pair of annular ribs 16*c*. In a mounted position the annular ribs 16*c* surrounds a part of the second bearing holder 13*b* to form a labyrinth seal. When the impulse turbine 16 is in rotation the separated contaminants from the drain outlet 10*b* will flow through the second bearing 13*a* and through the labyrinth seal into the drive chamber 3*b*. The nozzle 17 is disposed in close vicinity of the buckets 16*a* with its nozzle opening 17*a* directed against the buckets 16*a* in a tangential direction relative to the turbine 16. This can also be seen in FIG. 3, showing a cross-section of the turbine 16 and nozzle 17. The impulse from the oil jet acts on the bucket 16*a* more effectively as the fluid jet is relatively focused in the vicinity of the nozzle opening 17*a*. In practice, the opening 17*a* of the nozzle is arranged at a distance of 0.5-5 mm from the impulse turbine 16.

Figure 4:
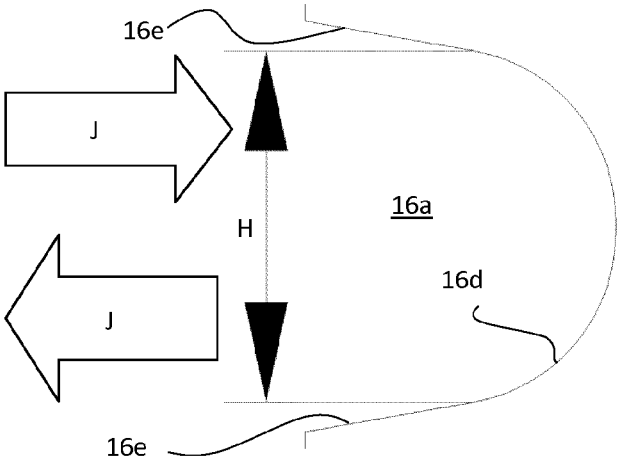
FIG. 4 shows a longitudinal section along a bucket of the impulse turbine.

Furthermore, the height H of the buckets 16*a* is 2-3 times the diameter of the nozzle opening 17*a*. As shown in FIG. 2, the nozzle opening 17*a* is disposed such as to direct the oil jet into an upper half of the bucket 16*a*. The inside of the bucket 16*a* is configured with a curvature 16*d* to reverse the direction of the oil jet J along the height H of the bucket 16*a* (which is also shown in FIG. 4), such that an impulse is provided on the turbine 16 to rotate the centrifugal rotor 2. Hence, the oil jet J is received in the upper half of the bucket 16*a*, inside which the oil jet is reversed to exit a lower half of the bucket 16*a*. An impulse turbine with such a height H has been found to be very efficient in particular at high speed rotation (e.g. 6 000-14 000 rpm) of the centrifugal rotor for the cleaning of crankcase gas.

FIG. 3 discloses a cross-section (i.e. taken in the horizontal plane) of the impulse turbine 16 and nozzle 17 according to FIG. 2. As mentioned above it can be seen that the nozzle opening 17*a* is directed against the bucket 16*a* in the tangential direction of the turbine 16. The oil jet J is ejected at a velocity V1 from the nozzle opening 17*a*. The speed V1 of the oil jet may vary somewhat with the engine speed, since the oil pump is connected to the engine in such a way that oil pressure will vary with engine speed. Hence, an increase in oil pressure will also increase the oil jet speed V1, whereby the impulse turbine 16 and centrifugal rotor 2 will rotate faster. The prevailing speed V1 of the oil jet may for instance be found by taking the oil volume flow divided by the cross-sectional area of the nozzle opening 17*a*. The impulse turbine 16 has a tangential speed V2 at a radius R where the fluid jet hits the bucket 16*a*. As shown in FIG. 3 the radius R is the distance from the center of the impulse turbine 16 to the center of the bucket 16*a*. The impulse turbine 16 is dimensioned with this radius R such that a ratio V1/V2 between the oil jet speed V1 and the tangential speed V2 is 2-3 during operation of the centrifugal separator. Hence, the oil jet speed V1 is at least 2 times but not more than 3 times the tangential speed V2 of the impulse turbine at the radius R. Within this range the power curve of the impulse turbine peaks, whereby the turbine efficiency has been further increased in view of previous impulse turbines for driving centrifugal rotors.

The oil jet speed V1 may typically range from 20 m/s to 30 m/s during normal operation of a combustion engine (e.g. for a heavy-duty truck), wherein the tangential velocity V2 at the radius R is designed to be ½ to ⅓ of the oil jet speed V1. Hence, when considering the desired high rotational speeds (6 000 to 14 000 rpm) and the actual loads on the centrifugal rotor (blow-by gas rates of 40 to 800 liters per minute) the impulse turbine of the invention would typically be arranged with the radius R from approximately 10 mm to 15 mm. Since the radius R is measured to the center of the bucket 16*a* the radius measured to the outer circumference of the impulse turbine would be somewhat greater (e.g. 2 or 3 mm longer). Furthermore, the diameter of the nozzle opening 17*a* may for instance range from 2.1 mm to 2.9 mm, wherein the buckets 16*a* have approximately the same width as the diameter of the nozzle opening 17*a*. Consequently, the impulse turbine 16 is of relatively small size.

FIG. 4 discloses a longitudinal section along the bucket height H. The oil jet J is represented by large arrows. Furthermore, the bucket 16*a* is configured with a curved part 16*d* which transitions into upper and lower straight parts 16*e* which are outwardly diverging. The straight outwardly diverging parts 16*e* of the bucket 16*a* are configured to funnel the oil jet J into and out of the curved part 16*d* of the bucket 16*a*. Hence, as the oil jet J enters the upper half of the bucket, the upper straight part 16*e* guides the oil jet J into the curved part 16*d* and the lower straight part 16*e* guides the oil jet J out of the bucket 16*a*. The straight parts 16*e* of the bucket 16*a* may alternatively be arranged to extend in parallel, in particular if there is no need to guide or funnel the oil jet J into the curved part 16*b* of the bucket 16*a*. This would not be necessary for instance if the nozzle opening 17*a* is positioned well within the height H of the bucket 16*a*. The curved part 16*d* of the bucket 16*a* is where the oil jet J is reversed to provide the impulse on the turbine 16. Therefore, as shown in FIG. 4, the height H of the bucket 16*a* is in fact measured as the height of the curved part 16*d* only. However, in practice the height H may as well be measured at the opening of the bucket 16*a* to thereby include both the curved part 16*b* and the straight parts 16*e*, since this height is practically the same as the height H of the curved part 16*b*.

The invention claimed is:

1. A device for cleaning a gas which is contaminated with particles, which device comprises a centrifugal separator with a centrifugal rotor for separating the particles from the gas and a drive arrangement for rotating the centrifugal rotor about a rotational axis, the drive arrangement comprising an impulse turbine drivingly connected to the centrifugal rotor and a nozzle for a pressurized fluid, the impulse turbine being arranged with buckets for receiving a jet of pressurized fluid from the nozzle directed against the buckets which are configured such that the fluid jet direction is reversed along a height of the bucket, wherein the bucket height is 2-3 times the diameter of the nozzle opening.

2. The device according to claim 1, wherein the height of the bucket is 2-2.5 times the diameter of the nozzle opening.

3. The device according to claim 1, wherein the height of the bucket is 2.3 times the diameter of the nozzle opening.

4. The device according to claim 1, wherein the impulse turbine is configured with a radius such that a ratio (V1/V2) between the fluid jet speed and the tangential speed of the turbine at the radius where the fluid jet is arranged to hit the bucket is 2-3 during operation of the centrifugal separator.

5. The device according to claim 4, wherein the radius of the impulse turbine is configured such that said ratio (V1/V2) is 2.2-2.6.

6. The device according to claim 4, wherein the radius of the impulse turbine is configured such that said ratio (V1/V2) is 2.4.

7. The device according to claim 1, wherein the opening of the nozzle is arranged at a distance of 0.5-5 mm from the impulse turbine.

8. The device according to claim 1, wherein the buckets of the impulse turbine are configured with an inner curved part for reversing the fluid along the height of the bucket, which inner curved part transitions into outer straight parts diverging in a direction radially outward.

9. The device according to claim 1, wherein the nozzle is connectable to a fluid pressure source of an internal combustion engine and the centrifugal separator is arranged for cleaning crankcase gas produced by the internal combustion engine during operation.

10. The device according to claim 9, wherein the fluid is liquid and the fluid pressure source is a liquid pump of the combustion engine.

11. The device according to claim 10, wherein the liquid is oil or water and the fluid pressure source is an oil or water pump respectively.

12. The device according to claim 1, further comprising a housing for the impulse turbine and the nozzle, the housing enclosing a drive chamber of the centrifugal separator.

13. The device according to claim 12, wherein the centrifugal separator comprises a first housing part for the centrifugal rotor, which is connectable to a second housing part forming the housing for the impulse turbine and the nozzle.

14. The device according to claim 1, wherein the centrifugal rotor comprises a stack of separation discs for separating the particles from the gas.

15. The device according to claim 2, wherein the height of the bucket is 2.3 times the diameter of the nozzle opening.

16. The device according to claim 2, wherein the impulse turbine is configured with a radius such that a ratio (V1/V2) between the fluid jet speed and the tangential speed of the turbine at the radius where the fluid jet is arranged to hit the bucket is 2-3 during operation of the centrifugal separator.

17. The device according to claim 3, wherein the impulse turbine is configured with a radius such that a ratio (V1/V2) between the fluid jet speed and the tangential speed of the turbine at the radius where the fluid jet is arranged to hit the bucket is 2-3 during operation of the centrifugal separator.

18. The device according to claim 5, wherein the radius of the impulse turbine is configured such that said ratio (V1/V2) is 2.4.

19. The device according to claim 2, wherein the opening of the nozzle is arranged at a distance of 0.5-5 mm from the impulse turbine.

20. The device according to claim 3, wherein the opening of the nozzle is arranged at a distance of 0.5-5 mm from the impulse turbine.

* * * * *